United States Patent [19]

Braun

[11] Patent Number: 4,830,168

[45] Date of Patent: May 16, 1989

[54] COIN AND KEY OPERATED CAM LOCK

[76] Inventor: Emil J. Braun, Rt. 5, Northfield, Minn. 56301

[21] Appl. No.: 188,447

[22] Filed: Apr. 29, 1988

[51] Int. Cl.[4] ..... A47E 7/00

[52] U.S. Cl. ..... 194/254; 194/258

[58] Field of Search ..... 194/232–236, 194/249, 253, 254, 257, 258, 256; 70/DIG. 41

[56] References Cited

U.S. PATENT DOCUMENTS

| | | | |
|---|---|---|---|
| 636,962 | 11/1899 | Durham | 70/DIG. 41 |
| 982,689 | 1/1911 | Perrin | 70/DIG. 41 |
| 987,287 | 3/1911 | Duryea | 70/128 |
| 1,321,298 | 11/1919 | Frix | 70/DIG. 41 |
| 1,653,487 | 12/1927 | White | 70/128 |
| 2,437,742 | 3/1948 | Hofmann | 70/DIG. 41 |
| 3,394,790 | 7/1968 | Braun | 194/256 |
| 3,722,652 | 3/1973 | Busch | 194/256 |

*Primary Examiner*—Andres Kashnikow
*Assistant Examiner*—Patrick N. Burkhart
*Attorney, Agent, or Firm*—Palmatier & Sjoquist

[57] ABSTRACT

A coin and key operated cam lock comprising a cam disc mounted for rotation wherein the cam disc has a lock barrel disposed therein. A cam lever and release bar engaging ramp is provided on the cam disc which also has a coin receiving slot therein. A cam lever having a detent lug thereon is biased so that the detent lug will engage with the disc ramp to thereby releasably restrict rotation of the cam disc. A coin engaging surface is located on the underside of the lever and is engageable with a coin placed within the lock to force the detent lug out of engagement with the disc ramp to permit rotation of the cam disc to the fully locked position. The disc ramp also has stop shoulders engageable with the detent lug to prevent multiple uses of the cam lock after the coins have fallen out of the coin receiving slot. A cam release bar is moveably mounted so that it is accessible to the user from the outside of the cam lock and restricts the rotation of the cam disc from its fully locked position for easy key removal until the cam release bar is conscientiously forced out of engagement 1 with the disc ramp by the user to unlock the coin and key operated cam lock.

8 Claims, 4 Drawing Sheets

COIN AND KEY OPERATED CAM LOCK

BACKGROUND OF THE INVENTION

This invention relates to coin and key operated cam locks wherein a person places a coin into the lock and turns the key from its open to its locked position afterwhich the key may be removed. Such cam locks are typically used in lockable snow ski and pole racks, bicycle racks, rentable lockers and the like.

Coin and key operated cam locks are typically mounted on the inside of a wall or housing so that access to their working parts may not be had from the outside. From the outside one may view a coin receiving opening, perhaps part of the securing means or mechanism and a key which typically is only removable when the cam lock is in its fully locked position.

From the inside of the housing or wall, the working parts of the cam lock may be seen and generally include a cam disc mounted for rotation onto the mounting plate, wall or housing. A lock barrel is disposed within the disc so that the cam disc can be rotated by the key inserted into the lock barrel. A coin receiving slot is located within the cam disc alignable with the coin receiving opening in the plate or wall. A cam lever is suitably mounted on the plate or wall for pivotal movement about an axis parallel to the axis of rotation of the cam disc. The lever has a detent lug thereon which is adapted to engage a ramp of the cam disc to thereby releasably restrict rotation on the cam disc. The lever appropriately has a coin engaging surface engageable by a coin placed in the coin receiving slot through the coin receiving opening to force the detent lug out of engagement with the disc ramp to permit rotation of the cam disc towards its locked position.

Once the cam disc has reached its locked position, the coins fall out of the coin receiving slot into a separate coin receiving container. The key may then be removed from the key barrel for safe keeping until the user or key holder wishes to unlock the cam lock.

To prevent multiple uses of a single coin, the cam disc ramp has shoulder stops engageable with the detent lug which prevent the cam disc from moving from its fully locked position in a rotating manner towards the unlocked position and then back to the locked position again for key removal. Because the key can be removed from the key barrel only when the cam disc is fully and completely rotated to the locked position, a problem arises should there be any rotation of the cam disc from the locked position engaging a shoulder stop before the operator removes the key.

Consequently, users have experienced the loss of their coins without securing the properly rented key from of the cam lock. This often occurs when the user reaches the fully locked position of the cam lock and then wiggles the key to the point where the cam lever lug reaches a stop shoulder and will not permit the operator to again advance the cam disc to its fully locked position to enable him to remove the properly rented key.

This problem involves great service expense in that the cam locks must be inspected for proper operation and refunds must be distributed.

SUMMARY OF THE INVENTION

A coin and key operated cam lock comprising a cam disc mounted for rotation on a mounting plate with a coin receiving opening in the plate wherein the cam disc has a lock barrel disposed therein whereby tee cam disc can be rotated by means of a key in the lock barrel. A cam lever and release bar engaging ramp is provided on the cam disc which also has a coin receiving slot therein which is alignable with the coin receiving opening in the plate. A cam lever is mounted on the plate for pivotal movement about an axis parallel the axis of rotation of the cam disc having a detent lug thereon. The lever is biased so that the detent lug will engage with the disc ramp to thereby releasably restrict rotation of the cam disc. A coin engaging surface is located on the underside of the lever and is engageable with a coin placed within the coin receiving slot through the coin receiving opening to force the detent lug out of engagement with the disc ramp to permit rotation of the cam disc to the fully locked position. The disc ramp also has stop shoulders engageable with the detent lug to prevent multiple uses of the cam lock after the coins have fallen out of the coin receiving slot. Various locking mechanisms engageable with the cam disc may be utilized with the cam lock depending on its particular application. A cam release bar is moveably mounted to the mounting plate as it passes therethrough the mounting plate so that it is accessible to the user from the outside of the cam lock. The bar is biased to engage the ramp and adapted to releasably restrict the rotation of the cam disc from its fully locked position for easy key removal until the cam release bar is conscientiously forced out of engagement with the disc ramp by the user to permit the cam disc to return to its open position thereby unlocking the coin and key operated cam lock.

This invention advantageously provides a coin and key operated cam lock which will not permit the operator or user to turn the cam disc from its locked position towards its unlocked position unless the cam release bar is conscientiously moved away from it locking engagement with the cam disc ramp. This arrangement minimizes refunds and the need for service personnel to repeatedly check the coin operated key cam locks due to user complaints wherein refunds are demanded.

The coin and key operated key cam lock of the invention advantageously provides a cam lock with multiple applications including ski racks, bicycle racks, lockers and the like wherever a coin and key operated cam lock is desired to be used.

The coin and key operated key cam lock is economical to manufacture and simple to operate wherein the operator must conscientiously press the cam release bar to rotate the cam disc towards its open position after which the key can no longer be removed.

BRIEF DESCRIPTION OF THE DRAWINGS

FIG. is a side elevational view of the coin and key operated cam lock as taken through a cross-sectional view of the housing of a ski and pole locking rack.

DETAILED SPECIFICATION OF THE INVENTION

Figure 1:
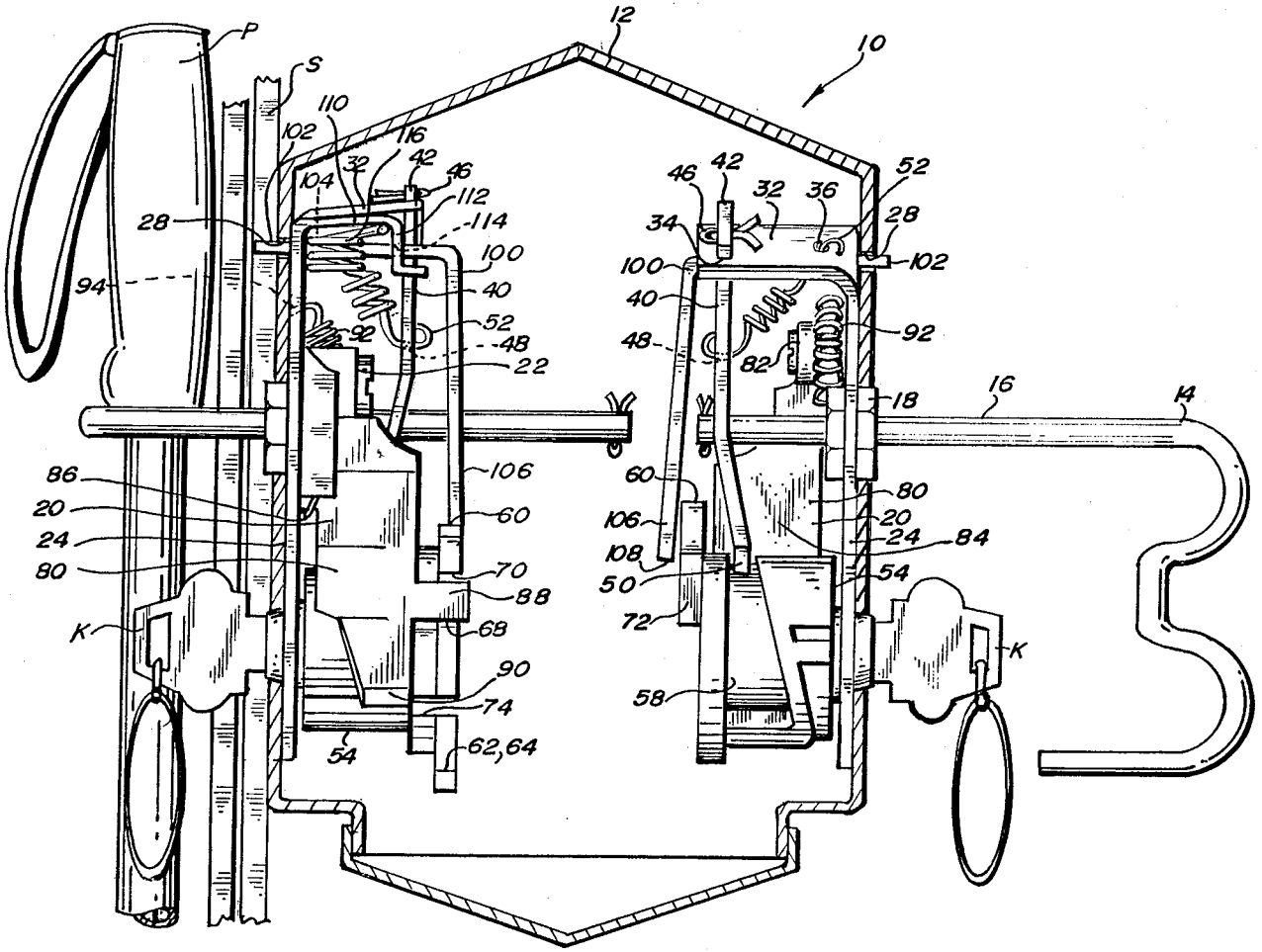
Figure 3:
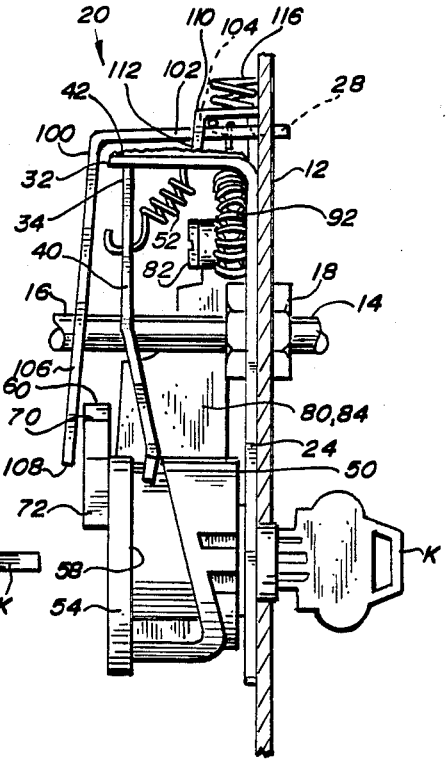
FIG. 3 is a side elevational view of the cam lock in its unlocked position with its inwardly turned plate portion partially cut away for clarity.
Figure 2:
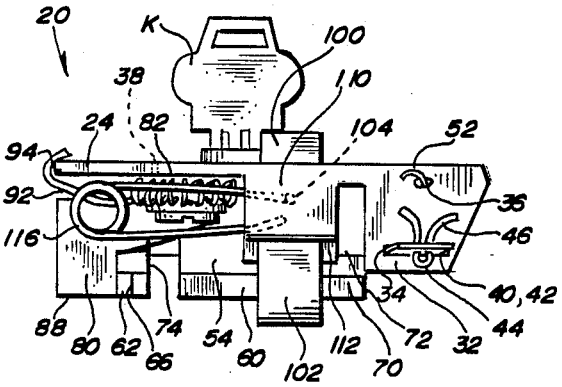
FIG. 2 is a top view of the cam lock of the invention.
Figure 5:
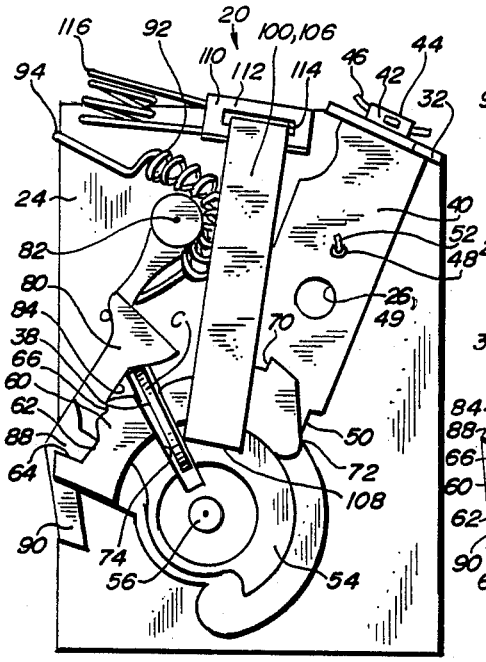
FIG. 5 is a front elevational view of the cam lock with coin inserted in its unlocked position.
Figure 6:
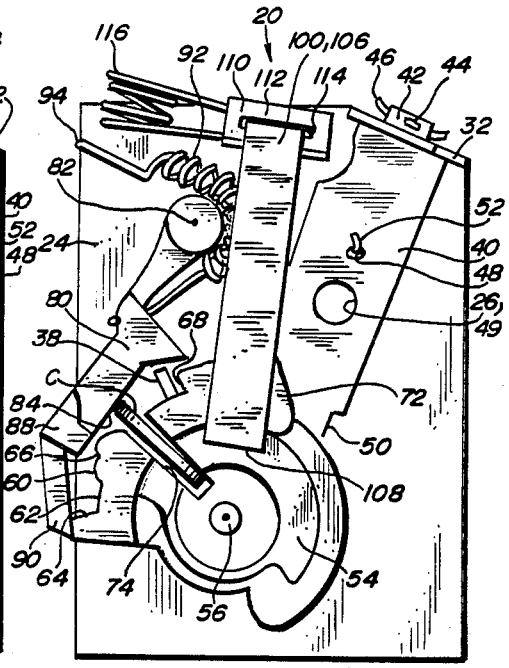
FIG. 6 is a front elevational view of the cam lock advanced toward its locked position.
Figure 7:
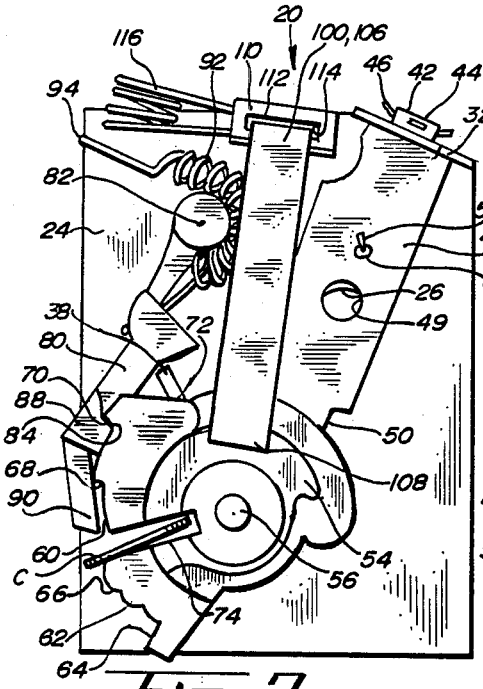
FIG. 7 is a front elevational view of the cam lock in its locked position.

Referring to FIGS. 1, 2 and 3, the structure of the coin and key operated cam lock 20 may generally be seen. For ease of understanding, the present cam lock 20 is disclosed in the context of a locking ski and pole rack 10 as described and claimed in my U.S. Pat. No. 3,394,790 for a Locking Apparatus For Skis And Poles, issued on July 30, 1968. It is to be understood that the cam lock 20 of the present invention may be utilized in other devices that are coin operated with a removable key, such as bicycle racks, lockers (FIGS. 9 and 10) and the like.

The coin and key operated cam lock 20 of the present invention is appropriately mounted on the inner side of housing 12 such as by rivets. Cam lock 20 is interconnected with a securing means such as a swingable clamping rod 14. A locking mechanism or rod break plate 40 is engageable with cam disc 54 which has a lock barrel 56 disposed therein. Cam lever and release bar engaging ramp 60 is peripherally located on cam disc 54. Cam lever 80 and cam release bar 100 are releasably engageable with cam disc ramp 60.

Clamping rod 14, which is swingable and comprises the securing means for skis S and poles P, has an elongate leg 16 that slidably passes through housing 12, through the combination of aperture and bushing 18, as it extends through the cam lock 20. Clamping rod 14 is prevented from being withdrawn therefrom by means of a conventional cotter pin passing through a suitable bore near the inner end of elongate leg 16.

Coin and key operated cam lock 20 appropriately has a mounting plate or wall 24 having a clamping rod aperture 26 (FIGS. 5–8), release bar slot 28, and an inwardly turned plate portion 32. Inwardly turned plate portion 32 is formed for convenience and economy in manufacture. However, a similar bracket may be welded to mounting plate 24 for similar function. Plate portion 32 has a rod break plate slot 34 and a spring mounting aperture 36. Coin receiving opening 38 is appropriately located in mounting plate 24 for easy alignment with coin receiving opening 19 in housing as is known.

The locking mechanism for cam lock 20 in its application in locking ski rack 10 suitably may be comprised of a rod brake plate 40 having an upper narrowed end 42 with an aperture 44 thereat. Narrow end 42 passes through slot 34 of inwardly turned plate portion 32 and is appropriately held thereat by cotter pin 46 which permits brake plate 40 to readily pivot about an axis parallel to the inwardly turned plate portion 32. Also, rod brake plate 40 has an aperture 48 therein whereby one end of tension spring 52 is held thereat while the other end of spring 52 is held in aperture 36 of plate portion 32 to thereby bias brake plate 40 towards the main portion of mounting plate 24. Rod brake plate 40 also has an aperture 49 which will permit elongate leg 16 of clamping rod 14 to pass therethrough. It also has follower 50 located distally from narrowed end 42.

Cam disc 54 is appropriately mounted for rotation on the mounting plate 24 and has a lock barrel 56 appropriately disposed therein whereby the cam disc 54 can be rotated by means of key K inserted in the lock barrel 56 from the outside of housing 12. Cam disc 54 also has a peripheral cam slot 58 wherein follower 50 of rod break plate 44 slidably fits and is held therein.

Cam disc 54 has a cam lever and release bar engaging ramp 60 which includes a peripheral recess 62 with forward recess end 64 and rearward recess end 66. First cam stop shoulder 68 and second cam stop shoulder 70 are appropriately located on disc ramp 60 which terminates at ramp end 72. Cam disc 54 also has a coin receiving slot 74 for coin C appropriately alignable with coin receiving opening 38 in mounting plate 24.

Cam lever 80 is pivotally mounted at 82 on mounting plate 24 so that cam lever 80 will pivotally move about an axis parallel to the axis of rotation of cam disc 54. Cam lever 80 suitably has a coin engaging surface 84 on its underside, detent lug 88 and tongue 90. Spring 92 is suitably connected between lever spring catch 86 and spring catch 94 on mounting plate 24 to effectively bias cam lever 80 onto cam disc ramp 60.

Cam release bar 100 has a short leg 102 with an aperture 104 thereat. Short leg 102 passes through bar slot 28 in mounting plate 24 to the outside of housing 12. Short leg 102 is slidably mounted thereat by passing through release bar bracket 110 appropriately welded to mounting bracket 24 although bracket 110 may be integral with mounting plate 24 such as a second inwardly turned plate portion. Cam release bar 100 is biased towards housing 12 or mounting plate 24 by action of spring 116 being mounted in aperture 104 and while beings et against downwardly turned portion 112 of release bar bracket 110. Short leg 102 also passes through slot 114 in downwardly turned portion 112 to facilitate its smooth inwardly - outwardly sliding action.

Cam release bar 100 also has a long leg 106 with a cam ramp locking end 108 which is biased to slide along the lateral or front side of cam disc ramp 60 as cam disc 54 is rotated in either direction. Once cam disc 54 reaches its fully locked position, biased cam locking end 108 drops off of cam ramp 60 and appropriately locks cam disc 54 in its locked position as locking end 108 of bar 100 is up against ramp end 72.

Referring to FIGS. 3–8, the operation of the coin and key operated cam lock 20 may be seen. With cam lock 20 in its unlocked position (FIGS. 3 and 5), detent lug 88 of cam lever 80 is effectively locked into cam ramp peripheral recess 62 prohibiting cam disc 54 from any substantial rotation in either direction. Coin C is then placed through coin receiving opening 38 for receipt within coin receiving slot 74 of cam disc 54. Key K may then be rotated counterclockwise to bring coin C into sliding contact with the coin engaging surface 84 of cam lever 80 thus lifting lever 80 and its detent lug 88 out of cam ramp peripheral recess 62 and away from recess ends 64 and 66 to permit rotation of cam disc 54. As coin C passes by detent lug 88 and tongue 90, coin C slides or falls out of coin receiving slot 74.

Figure 4:
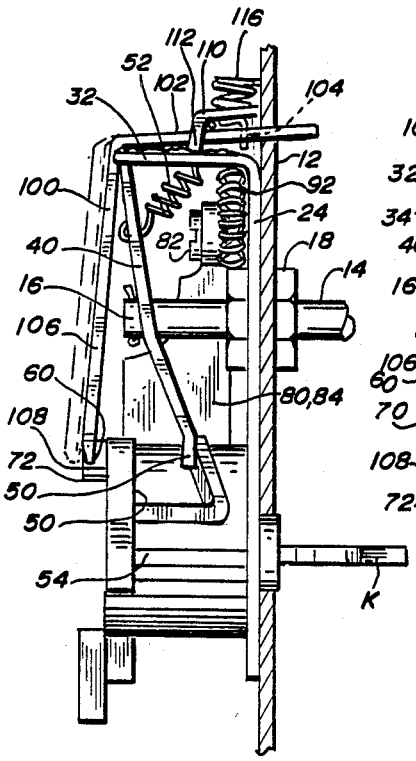
FIG. 4 is a side elevational view of the cam look in its unlocked position with the cam release bar shown in its released or disengaged position in broken outline and its inwardly turned plate portion partially cut away for clarity.

Simultaneously, rod brake plate 40, which is initially vertical, has its follower 50 at the beginning of peripheral cam slot 58 biased towards mounting plate 24 (FIG. 3). As cam disc 54 is rotated towards its locked position, biased rod brake plate 40 moves toward mounting plate 24 in a canted fashion by action of follower 50 sliding along in peripheral cam slot 58 (FIG. 4).

This arrangement permits inward but not outward movement of clamping rod 14 when the brake plate 40 is engaged. In other words, when brake plate 40 is canted, aperture 49 becomes offset with aperture 26 in mounting plate 26 so that brake plate 40 at aperture 49 will hold, bite or engage elongate leg 16 and prevent its movement in an outwardly direction. Spring 52 acts to hold brake plate 40 in its canted locked position. Any attempt to withdraw elongate leg 16 from housing 12 when break plate 40 is engaged will only serve to increase the holding action of brake plate 40. Thus, when brake plate 40 is engaged, it is possible to move the clamping rod 14 inwardly but outward motion is impossible.

Once the cam disc 54 is in its fully locked position, the cam locking end 108 of cam release bar 100 slides off of cam disc ramp 60 to butt against ramp end 72 to effectively prohibit clockwise rotation of cam disc 54. As was previously known, typically the user would jiggle or rotate key K and move the cam disc 54 from its locked position. Detent lug 88 of cam lever 80 would next engage first cam stop shoulders 68. This action would in turn prohibit the user from returning the cam disc 54 to its fully locked position after the coin C had been deposited within the cam lock 20 before the operator had removed the key K from the lock barrel 56.

Figure 8:
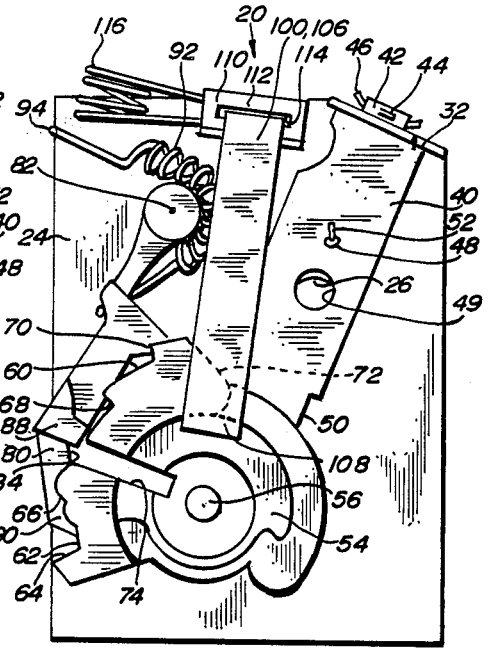
FIG. 8 is a front elevational view of the cam lock after the cam release bar has been disengaged and the user has begun to move the cam disc towards the lock's unlocked position.

The present invention prohibits any such clockwise rotation of the cam disc 54 until the operator conscientiously exerts an inward force on cam disc release bar 100 to effectively lift the cam locking end 108 of elongate leg 106 of release bar 100 away from the ramp end (FIG. 4) 72 to again permit the elongate leg 106 of release bar 100 to slide along cam disc ramp 60 as shown in FIG. 8. Once rod brake plate 40, by action of follower 50 within peripheral cam slot 58, again reaches its vertical position, elongate leg 16 of clamping rod 14 may be outwardly withdrawn to permit the unlocking of the securing means of cam lock 20.

Figure 9:
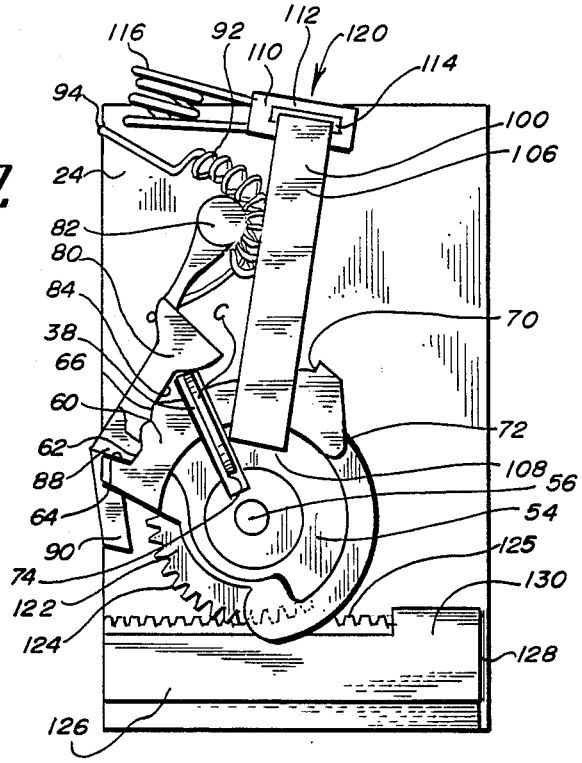
FIG. 9 is a front elevational view of a variation of the cam lock with gear and rack securing means in its unlocked position.
Figure 10:
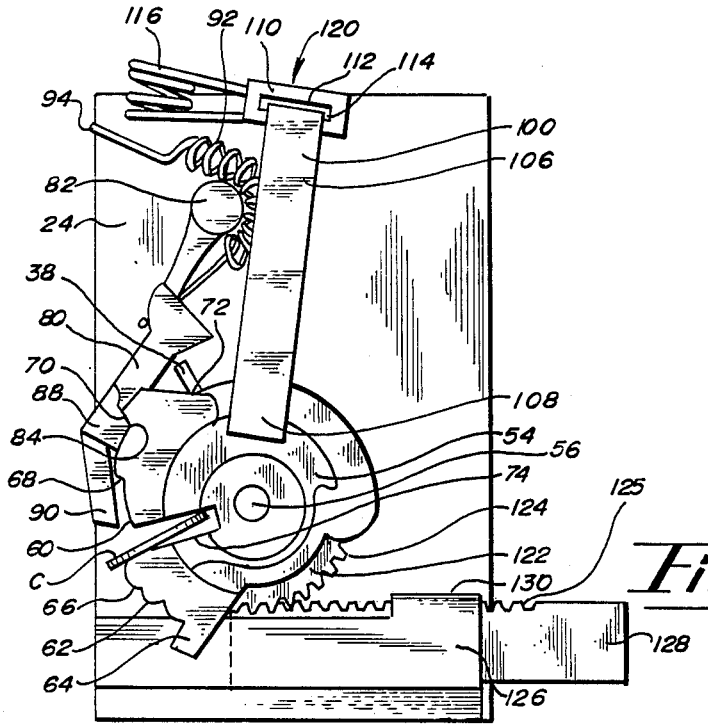
FIG. 10 is a front elevational view of a variation of the cam lock with the gear and rack securing means in its locked position.

Referring to FIGS. 9 and 10, a modified cam lock 120 may be seen in its respective unlocked and locked positions. Cam lock 120 is substantially the same as cam lock 2 with a different locking mechanism than rod brake plate 40. In all other respects, cam locks 20 and 120 are substantially similar and so identified.

Cam lock 120 has a partial wheel or ring 122 fixed onto rotatable lock barrel 56 adjacent plate 24 with teeth or cogs 124 on its outer periphery. Mounting plate 24 has an elongate rack guide 126 mounted thereon below barrel 56. Guide 126 movably supports and guides lateral movement of rack 128 while wheel 122 and tab 130 movably retain rack 128 within guide 126. Rack 128 also has cogs 125 which cooperatively mesh with cogs 124 on wheel 122 to move rack 128 as wheel 122 and barrel 56 are rotated by a key. Rack 128 effectively functions as a lock bolt. Cam lock 120 is suitable for locker usage.

The present invention may be embodied in other specific forms without departing from the spirit or essential attributes thereof; therefore, the illustrated embodiment should be considered in all respects as illustrative and not restrictive, reference being made to the appended claims rather than to the foregoing description to indicate the scope of the invention.

What is claimed:

1. A coin and key operated cam lock, comprising:

(a) a cam disc mounted for rotation on a mounting plate with a coin receiving opening in the plate, the cam disc having a lock barrel disposed therein whereby the cam disc can be rotated by means of a key inserted in the lock barrel, the cam disc also having a peripheral cam lever and release bar engaging ramp and a coin receiving slot alignable with the coin receiving opening;

(b) a cam lever mounted on the plate for pivotal movement about an axis parallel to the axis of rotation of the cam disc having detent lug thereon and being biased to engage the detent lug with the disc ramp to thereby releasably restrict rotation of the cam disc and further having a coin engaging surface engageable by a coin placed within the coin receiving slot through the coin receiving opening wherein the coin will force the detent lug out of engagement with the disc ramp upon rotation of the cam disc to further permit rotation of the cam disc; and (c) a cam release bar having a short leg and a long leg with a cam locking end, the short leg being slidably mounted to and passing through the mounting plate adapted to be operator accessible from outside the cam lock and the bar being biased so that the cam locking end is slidably engageable with the ramp to releasably releasably restrict rotation of the cam disc by its engagement with the ramp.

2. The coin and key operated cam lock of claim 1, further comprising a locking mechanism engageable with the cam disc for locking and opening the cam lock as the cam disc is rotated.

3. The coin and key operated cam lock of claim 1, wherein the peripheral cam lever and release bar engaging ramp has a recess and a stop shoulder thereon.

4. The coin and key operated cam lock of claim 2, further comprising cam disc peripheral recess in the cam disc for operably guiding and holding the locking mechanism therein to thereby lock and open the cam lock.

5. The coin and key operated cam lock of claim 1, wherein the cam release bar is moveably mounted to the mounting plate having one end extending out of the cam lock accessible by the operator while having a second end engageable with the engaging ramp whereby the operator may move the bar away from the ramp to permit rotation of the cam disc.

6. The coin and key operated cam lock of claim 1, wherein the cam lock is adapted to hold a swingable clamping rod by means of a locking mechanism comprised of a rod brake plate with an aperture therein pivotally mounted at one end to the mounting plate substantially perpendicular to the axis of rotation of the cam disc having a follower at one end disposed in a cam disc peripheral recess to cant the plate as the cam disc is rotated to releasably hold the clamping rod disposed in the aperture.

7. The coin and key operated cam lock of claim 2, wherein the locking mechanism comprises cogs about the lock barrel, a rack with cogs and a rack guide, the respective cogs of the barrel and rack cooperatively mesh together to move rack in the guide as the barrel is rotated.

8. A coin and key operated cam lock adapted for securely retaining a pair of snow skis and poles, comprising:

(a) a swingable ski clamping rod slidably passing through a mounting plate;

(b) a cam disc mounted for rotation on a mounting plate with a coin receiving opening in the plate, the cam disc having a lock barrel disposed therein whereby the cam disc can be rotated by means of a key inserted in the lock barrel, a peripheral cam lever and release bar engaging ramp and a coin receiving slot alignable with the coin receiving opening;

(c) a cam lever mounted on the plate for pivotal movement about an axis parallel to the axis of rotation of the cam disc having a detent lug thereon and being biased to engage the detent lug with the disc ramp to thereby releasably restrict rotation of the cam disc and further having a coin engaging surface engageable by a coin placed in the coin receiving slot through the coin receiving opening wherein the coin will force the detent lug out of engagement with the disc ramp to further permit rotation of the cam disc;

(d) a cam release bar having a short leg and a long leg with a cam locking end, the short leg being slidably mounted to and passing through the mounting plate adapted to be operator accessible from outside the cam lock and the bar being biased so that the cam locking end is slidably engageable with the ramp to releasably restrict rotation of the cam disc by its engagement with the ramp; and (e) a rod brake plate with an aperture therein through which the clamping rod slidably passes therethrough being pivotally mounted at one end substantially perpendicular to the axis of rotation of the cam disc having a follower at its other end disposed in a cam disc peripheral recess to thereby cant the plate as the cam disc is rotated to releasably hold the clamping rod disposed in the aperture.

* * * * *